US008583001B2

(12) United States Patent
Kubo et al.

(10) Patent No.: US 8,583,001 B2
(45) Date of Patent: Nov. 12, 2013

(54) DEVELOPING DEVICE AND PROCESS CARTRIDGE

(75) Inventors: Yukio Kubo, Susono (JP); Susumu Nittani, Suntou-gun (JP); Yosuke Kashiide, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 254 days.

(21) Appl. No.: 13/024,704

(22) Filed: Feb. 10, 2011

(65) Prior Publication Data

US 2011/0200353 A1 Aug. 18, 2011

(30) Foreign Application Priority Data

Feb. 15, 2010 (JP) ..... 2010-030299
Feb. 4, 2011 (JP) ..... 2011-022870

(51) Int. Cl.
*G03G 15/08* (2006.01)

(52) U.S. Cl.
USPC ..... 399/103

(58) Field of Classification Search
USPC ..... 399/103, 106
See application file for complete search history.

(56) References Cited

U.S. PATENT DOCUMENTS

| | | | |
|---|---|---|---|
| 6,459,869 | B2 | 10/2002 | Nittani et al. |
| 6,463,234 | B2 | 10/2002 | Arimitsu et al. |
| 6,681,088 | B2 | 1/2004 | Kanno et al. |
| 6,834,171 | B2 | 12/2004 | Nittani et al. |
| 6,980,758 | B2 | 12/2005 | Murayama et al. |
| 7,024,137 | B2 | 4/2006 | Nittani et al. |
| 7,027,756 | B2 | 4/2006 | Hoshi et al. |
| 7,072,603 | B2 | 7/2006 | Tsuzuki et al. |
| 7,088,938 | B2 | 8/2006 | Hashimoto et al. |
| 7,088,939 | B2 | 8/2006 | Maeshima et al. |
| 7,162,181 | B2 | 1/2007 | Maeshima et al. |
| 7,215,909 | B2 | 5/2007 | Nittani et al. |
| 7,272,339 | B2 | 9/2007 | Tsuzuki et al. |
| 7,340,197 | B2 | 3/2008 | Murayama et al. |
| 7,386,241 | B2 | 6/2008 | Mori et al. |
| 7,509,071 | B2 | 3/2009 | Yoshimura et al. |
| 7,512,361 | B2 | 3/2009 | Kawamura et al. |

(Continued)

FOREIGN PATENT DOCUMENTS

| | | | |
|---|---|---|---|
| JP | 05035069 A | * | 2/1993 |
| JP | 2001-255741 | | 9/2001 |

OTHER PUBLICATIONS

Kitajima et al. (JP 05-035069 A) Feb. 1993, JPO Machine Translation.*

*Primary Examiner* — David Gray
*Assistant Examiner* — Erika J Villaluna
(74) *Attorney, Agent, or Firm* — Fitzpatrick, Cella, Harper & Scinto

(57) ABSTRACT

A developing device includes a developing container, provided with an opening, for containing a developer; a developing roller, provided at the opening, for forming a developer image on an image bearing member; a seal member, provided at the opening along an end portion of the developing roller, for preventing toner leakage from a gap between the opening and the developing roller; and a developer supplying roller, including a core material and a cylindrical elastic member which is provided around the core material and is contacted to the developing roller, for supplying the developer to the developing roller. The cylindrical elastic member has an end surface and a central portion with respect to a longitudinal direction thereof. The end surface has an outer diameter larger than that of the central portion so as to be in non-contact with the seal member.

10 Claims, 11 Drawing Sheets

(56) References Cited

U.S. PATENT DOCUMENTS

| | | | |
|---|---|---|---|
| 7,715,746 | B2 | 5/2010 | Tanabe et al. |
| 7,813,671 | B2 | 10/2010 | Nittani et al. |
| 7,856,192 | B2 | 12/2010 | Koishi et al. |
| 7,860,433 | B2 | 12/2010 | Toba et al. |
| 7,869,740 | B2 | 1/2011 | Yoshimura et al. |
| 7,890,012 | B2 | 2/2011 | Koishi et al. |
| 7,894,733 | B2 | 2/2011 | Tanabe et al. |
| 7,953,340 | B2 | 5/2011 | Tanabe et al. |
| 2001/0021318 | A1 | 9/2001 | Hashimoto et al. |
| 2011/0064459 | A1 | 3/2011 | Toba et al. |
| 2011/0110682 | A1 | 5/2011 | Yoshimura et al. |
| 2011/0116832 | A1 | 5/2011 | Koishi et al. |
| 2011/0123223 | A1 | 5/2011 | Koishi et al. |

* cited by examiner

DEVELOPING DEVICE AND PROCESS CARTRIDGE

FIELD OF THE INVENTION AND RELATED ART

The present invention relates to a developing device and a process cartridge which are to be used in an electrophotographic image forming apparatus, of an electrophotographic type, such as a copying machine or a printer.

Here, the electrophotographic image forming apparatus forms an image on a recording material by using the electrophotographic method. Examples of the electrophotographic image forming apparatus may include an electrophotographic copying machine, an electrophotographic printer (e.g., a laser beam printer, an LED printer or the like), a facsimile machine, a word processor, and the like.

Further, the process cartridge is prepared by integrally assembling an electrophotographic photosensitive member and, as process means, a charging means, a developing means and a cleaning means into a cartridge, which is detachably mountable to an electrophotographic image forming apparatus main assembly.

Further, the developing device integrally includes the developing means for developing an electrostatic latent image on the electrophotographic photosensitive member and constitutes a part of the process cartridge or is singly mounted detachably to the electrophotographic image forming apparatus including the electrophotographic photosensitive member.

In the electrophotographic image forming apparatus such as the printer using the electrophotographic process, the photosensitive (photosensitive drum) which is an image bearing member is electrically charged uniformly and is subjected to selective exposure to form a latent image. The latent image is developed with toner as a developer, and a resultant toner image is transferred onto the recording material and then is subjected to application of heat and pressure to be fixed on the recording material, so that an image is recorded (formed).

Such an apparatus is subjected to toner supply or maintenance of various process means. For this reason, as a means for facilitate a toner supplying operation or the maintenance, all or a part of the photosensitive drum, the charging means, the developing means, the cleaning means and the like have been integrally incorporated into a frame to prepare a cartridge. That is, a cartridge type in which the cartridge is detachably mountable to the image forming apparatus is employed. According to this cartridge type, the maintenance of the apparatus can be performed by a user himself (herself) in the form of exchange of the cartridge, so that operativity can be remarkably improved. Therefore, the cartridge type has been widely used in the image forming apparatus.

Such a cartridge at least includes, as described in Japanese Laid-Open Patent Application (JP-A) 2001-255741, a developing roller for developing the electrostatic latent image formed on the photosensitive drum and a developing container, provided with an opening through which the developer is to be supplied to the developing roller, for containing the toner. Further, the cartridge includes a developer supplying roller for supplying the toner as the developer to the developing roller and a developing blade for regulating uniformly an amount of the toner on the developing roller (FIGS. 2 to 4 of JP-A 2001-255741). Further, the cartridge includes an end portion seal member, provided at both end portions of the opening of the developing container, for preventing toner leakage from a gap among the developing blade, the developing roller end portions and the developing container (FIGS. 4, 7 and 8 of JP-A 2001-255741).

Here, in the cartridge type, the user himself (herself) performs an operation for mounting and demounting the cartridge with respect to the image forming apparatus main assembly when the maintenance is performed, so that no toner leakage from the cartridge is one of important functions. With market expansion in recent years, the electrophotographic image forming apparatus has been required to be a further small-sized apparatus capable of being used in various environments. For this purpose, the cartridge is required to reduce a clearance among parts for downsizing. Therefore, a constitution in which a width of a bearing surface, for end portion seal member application, of the developing container is substantially equal to a width of the end portion seal member and a clearance between an end surface of the developer supplying roller and an inner end surface of the opening of the developing container which is one end of the bearing surface for the end portion seal member application is reduced has been employed (FIG. 8 of JP-A 2001-255741).

However, in such a constitution, due to a variation in tolerance of the parts, there was a possibility that the end portion seal member and the end portion of the developer supplying roller were contacted to each other. If the end portion seal member and the end portion of the developer supplying roller which was a rotatable member were contacted to each other, the toner was liable to enter the gap of the end portion seal member, so that there was a possibility that the toner passed through the gap of the end portion seal member to be leaked to the outside of the developing device. Further, when the tolerance of the parts is strictly set in order to prevent the contact between the end portion seal member and the developer supplying roller, there is a possibility of influences on an increase in cost and on mass-productivity. Further, also in the case where a constitution in which piles of the end portion seal member are not removed even when the end portion seal member and the end portion of the developer supplying roller which is the rotatable member are contacted to each other is employed, similarly as in the above case, there is the possibility of influences on the increase in cost and on the mass-productivity.

SUMMARY OF THE INVENTION

A principal object of the present invention is to provide a developing device and a process cartridge which less influence on toner leakage and an increase in cost and have realized downsizing.

According to an aspect of the present invention, there is provided a developing device comprising:

a developing container, provided with an opening, for containing a developer;

a developing roller, provided at the opening, for forming a developer image on an image bearing member;

a first seal member, provided at the opening along an end portion of the developing roller, for preventing toner leakage from a gap between the opening and the developing roller; and a developer supplying roller, including a core material and a cylindrical elastic member which is provided around the core material and is contacted to the developing roller, for supplying the developer to the developing roller, wherein the cylindrical elastic member has an end surface and a central portion with respect to a longitudinal direction thereof, and wherein the end surface has an outer diameter larger than that of the central portion so as to be in non-contact with the seal member.

According to another aspect of the present invention, there is provided a process cartridge comprising:

an image bearing member for bearing an electrostatic latent image;

a developing container, provided with an opening, for containing a developer;

a developing roller, provided at the opening, for forming a developer image on the image bearing member;

a first seal member, provided at the opening along an end portion of the developing roller, for preventing toner leakage from a gap between the opening and the developing roller; and a developer supplying roller, including a core material and a cylindrical elastic member which is provided around the core material and is contacted to the developing roller, for supplying the developer to the developing roller, wherein the cylindrical elastic member has an end surface and a central portion with respect to a longitudinal direction thereof, and wherein the end surface has an outer diameter larger than that of the central portion so as to be in non-contact with the seal member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The developing device and the process cartridge according to the present invention will be described below more specifically with reference to the drawings.

(Embodiment 1)

<General Structure of Image Forming Apparatus>

Figure 1:
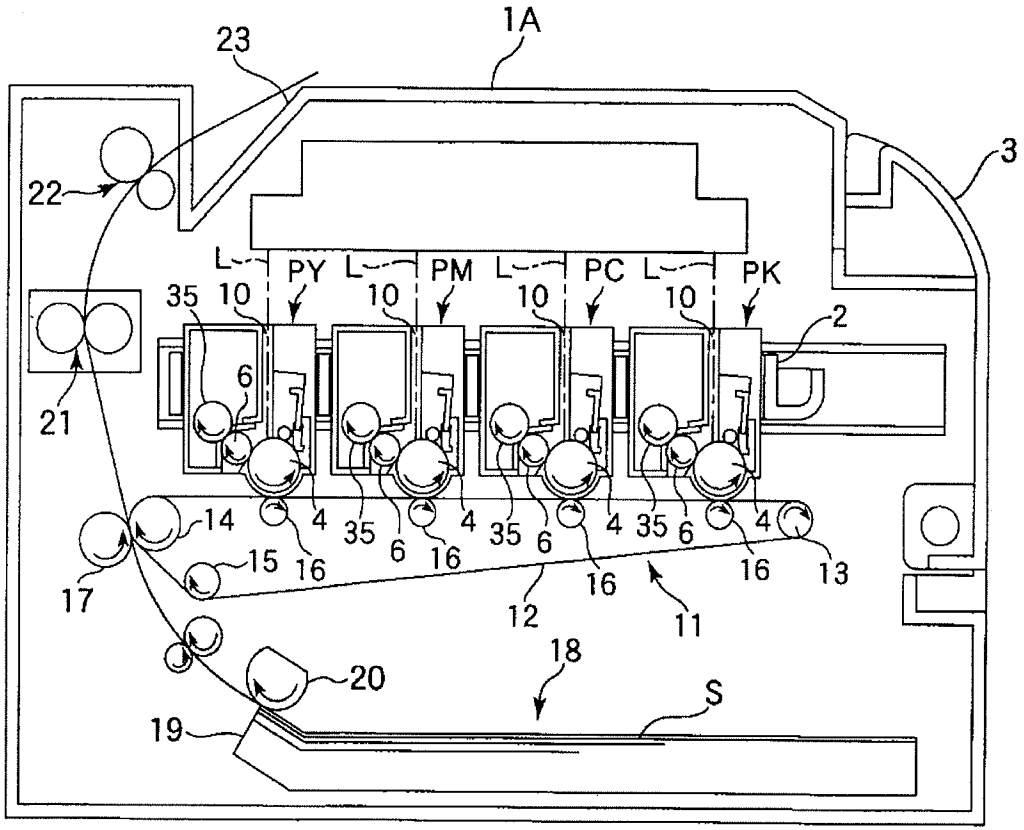
FIG. 1 is a schematic sectional view showing a general structure of an electrophotographic image forming apparatus to which a developing device and a process cartridge, according to the present invention, are applied.

FIG. 1 show a schematic sectional structure of a color electrophotographic image forming apparatus in this embodiment in which the developing device and the process cartridge according to the present invention are mounted. This image forming apparatus 1A (hereinafter referred to as an apparatus main assembly 1A) is a four color-based full-color laser printer using the electrophotographic process and effects image formation on a recording material S. This apparatus is of a process cartridge type in which the process cartridge is detachably mountable to the apparatus main assembly 1A and a color image is formed on the recording material S.

Here, in the following description, with respect to the apparatus main assembly 1A, the side (surface) on which an apparatus opening and closing door 3 is provided is referred to as a front side (surface), and a side (surface) opposite to the front side (surface) is referred to as a rear side (surface). The left and right of the apparatus main assembly 1A are those when the apparatus main assembly 1A is viewed from the front side.

In the apparatus main assembly 1A, four process cartridges P (PY, PM, PC, PK) are horizontally provided and mounted. Each of the cartridges P is accommodated at a process cartridge accommodating portion 2 of the apparatus main assembly 1A. Each cartridge P is capable of being exchanged and is subjected to mounting and demounting thereof by opening the apparatus opening and closing door 3 and by pulling out the process cartridge accommodating portion 2 in the front direction.

The respective cartridges P have similar electrophotographic process mechanisms and are different in color of developers (toners) and in filling amount of the toners. To each cartridge P located at the accommodating portion 2, a rotational driving force is transmitted from a driving input portion (not shown) of the apparatus main assembly 1A. Further, to the cartridge P, a bias voltage (charging bias, developing bias or the like) is applied from the apparatus main assembly 1A.

Figure 4:
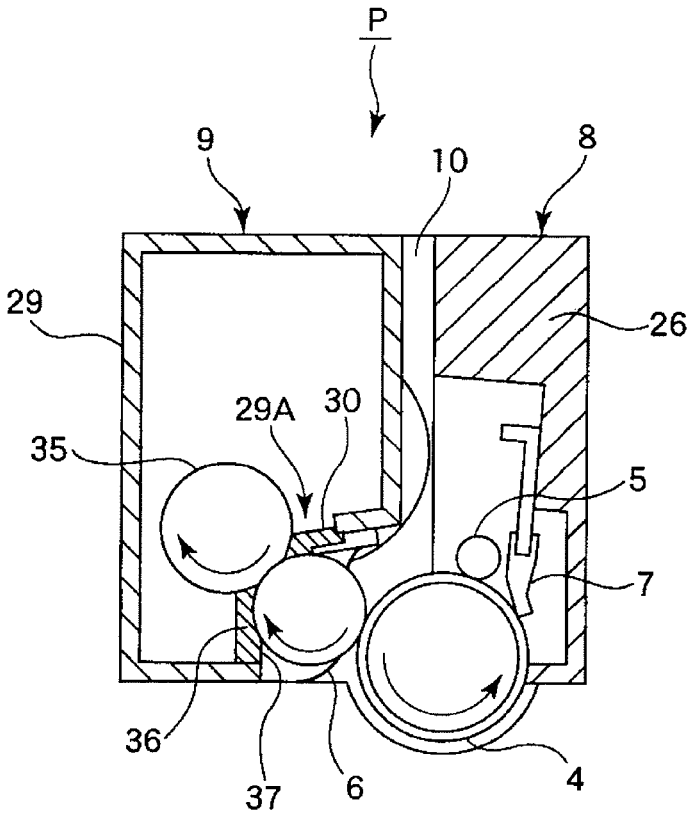
FIG. 4 is a schematic sectional view of the process cartridge including the developing device of the present invention in the embodiment.

As shown in FIG. 4, each cartridge P in this embodiment includes a photosensitive drum unit 8 provided with a drum-like electrophotographic photosensitive member 4 as an image bearing member (hereinafter referred to as a photosensitive drum) and, as process means, a charging means 5 and a cleaning member 7 which act on the photosensitive drum 4. Further, each cartridge P includes a developing device 9 provided with a developing means for developing an electrostatic latent image on the photosensitive drum 4 into a developer image (toner image). The photosensitive drum unit 8 and the developing device 9 are connected with each other. As the charging means, a charging roller 5 is used. As the cleaning means, a cleaning blade 7 is used. As the developing means, a developing roller 6 is used. A more specific constitution of each cartridge P will be described later.

The first cartridge PY accommodates the toner of yellow (Y) in its developing container and forms the toner image of yellow on the surface of the photosensitive drum 4. The second cartridge PM accommodates the toner of magenta (M) and forms the toner image of magenta on the surface of its developing container. The third cartridge PC accommodates the toner of cyan (C) in its developing container and forms the toner image of cyan on the surface of the photosensitive drum 4. The fourth cartridge PK accommodates the toner of black (K) and forms the toner image of black on the surface of its developing container.

Referring to FIG. 1, above the cartridges P (PY, PM, PC, PK), a laser scanner unit LB as an exposure means is provided. This laser scanner unit LB outputs laser light L correspondingly to image information. Then, the laser light passes through an exposure window portion 10, so that the surface of the photosensitive drum 4 is subjected to scanning exposure to the laser light L.

Under the cartridges P (PY, PM, PC, PK), an intermediary transfer belt unit 11 as a transfer member is provided. This intermediary transfer belt unit 11 includes a flexible endless transfer belt 12 and rollers, for stretching and rotating the transfer belt 12, including a driving roller 13, a turn roller 14 and a tension roller 15. The photosensitive drum 4 of each cartridge P is contacted to an upper surface of the transfer belt 12 at its lower surface. A resultant contact portion is a primary transfer portion. Inside the transfer belt 12, primary transfer rollers 16 are provided opposed to the associated photosensitive drums 4. Oppositely to the turn roller 14, a secondary transfer roller 17 is provided in contact with the transfer belt 12. A resultant contact portion between the transfer belt 12 and the secondary transfer roller 17 is a secondary transfer portion.

Below the intermediary transfer belt unit 11, a sheet feeding unit 18 is provided. This sheet feeding unit 18 includes a sheet feeding tray in which sheets of the recording material S are stacked and includes a sheet feeding roller 20 and the like.

At an upper rear portion of the apparatus main assembly 1A, a fixing unit 21 and a sheet discharging unit 22 are provided. An upper surface of the apparatus main assembly 1A constitutes a sheet discharge tray 23.

Each of the cartridges P (PY, PM, PC, PK) accommodated at the cartridge accommodating portion 2 is pressed from above by a pressing mechanism (not shown) on the apparatus main assembly 1A side. Further, to a drive input portion of each cartridge P, a drive output portion on the apparatus main assembly 1A side is connected (not shown). Further, to input electrical contacts on each cartridge side, an electric power supplying system (not shown) on the apparatus main assembly 1A side is electrically connected.

<Image Forming Operation>

An operation for forming a full-color image is as follows. In FIG. 1, the photosensitive drums 4 of the first to fourth cartridges P (PY, PM, PC, PK) are rotationally driven in a (counterclockwise) direction indicated by arrows at a predetermined speed. The transfer belt 12 is also rotationally driven in a direction indicated by arrows (codirectionally with the photosensitive drums at their contact portions) at a speed corresponding to the speed of the photosensitive drums 4. The laser scanner unit LB is also driven. In synchronism with this drive, the surface of the photosensitive drum 4 of each cartridge P is uniformly charged to a predetermined polarity and a predetermined potential by the charging roller 5. The laser scanner unit LB scans and exposes the surface of each photosensitive drum 4 with the laser light L depending on an image signal for an associated color. As a result, an electrostatic latent image depending on the image signal for the associated color is formed on the surface of each photosensitive drum 4. The thus formed electrostatic latent image is developed into a developer image (toner image) by the developing roller 6 which is rotationally driven in a (clockwise) direction indicated by an arrow at a predetermined speed.

By the electrophotographic image forming operation as described above, on the photosensitive drum 4 of the first cartridge PY, a yellow toner image corresponding to a yellow component for the full-color image is formed. Then, the toner image is primary-transferred onto the transfer between 12.

Similarly, on the photosensitive drum 4 of the s second cartridge PM, a magenta toner image corresponding to a magenta component for the full-color image is formed. Then, the toner image is primary-transferred superposedly onto the yellow toner image which has already been transferred on the transfer belt 12.

Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12.

Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, with predetermined control timing, one sheet of the recording material S is separated and fed. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color toner images superposed on the transfer belt 12 are collectively transferred onto the surface of the recording material S.

The recording material S is separated from the surface of the transfer belt 12 and then is introduced into a fixing unit 21, in which the recording material S is heated and pressed. As a result, the respective color toner images are fixed on the recording material S. Then, the recording material S comes out of the fixing device 21 and is discharged on the sheet discharge tray 23 by the sheet discharging unit 22 as an image-formed product.

<Constitution of Process Cartridge>

Figure 3:
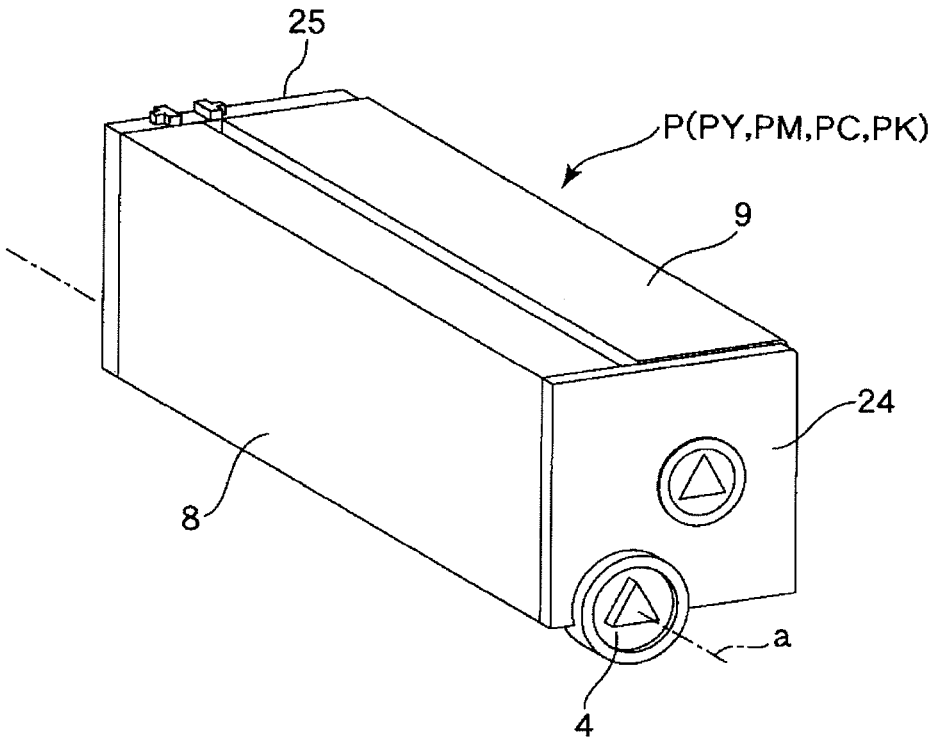
FIG. 3 is a perspective view of an outer appearance of the process cartridge including the developing device of the present invention in an embodiment.

As shown in FIG. 3, each of the cartridges P (PY, PM, PC, PK) has an elongated shape extending in a rotational axis direction a of the photosensitive drum 4 as its longitudinal direction. When the cartridge P is viewed from the front side of the apparatus main assembly, a right side is a drive side and a left side in a non-driving side. The cartridge P includes the photosensitive drum unit 8, the developing device 9, a driving side cover member 24 and a non-driving side cover member 25.

FIG. 4 shows a schematic sectional structure of the process cartridge P.

Figure 6:
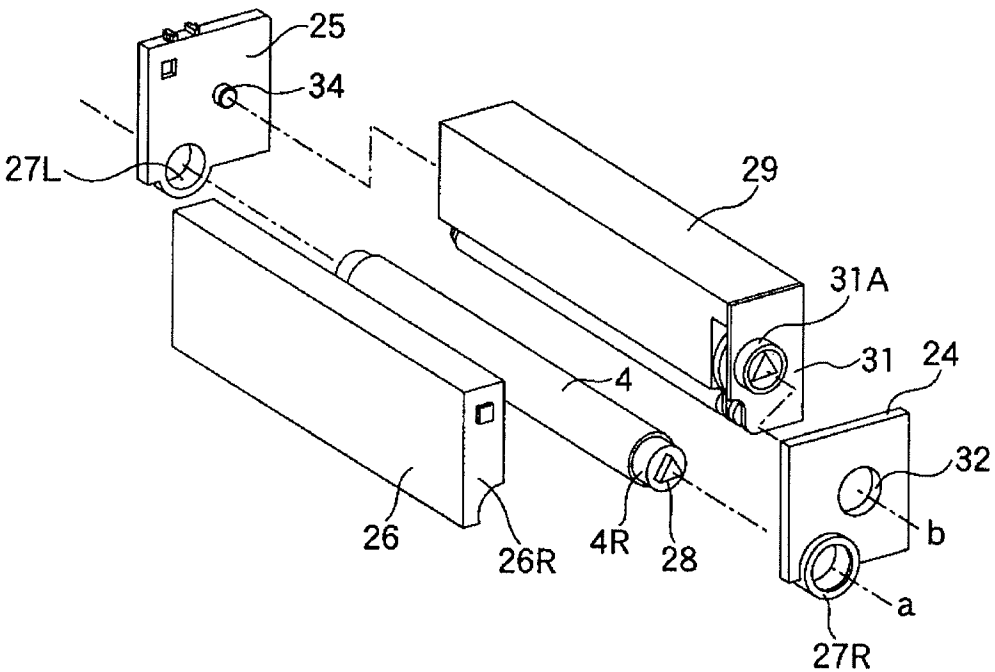
FIG. 6 is an exploded perspective view of the process cartridge of the present invention in the embodiment.

The photosensitive drum unit 8 is constituted by a cleaning device 26 including the cleaning blade 7 and by the photosensitive drum 4 and the charging roller 5. The photosensitive drum 4 is rotatably supported, on the non-driving side, by a photosensitive drum supporting portion 27L of the non-driving side cover member 25 shown in FIG. 6 and is rotatably supported, on the driving side, by a photosensitive drum supporting portion 27R of the driving side cover member 24 as shown in FIG. 6. To an end portion 4R on the driving side of the photosensitive drum 4, a drum driving coupling (drive transmission portion) 28 as a photosensitive drum drive input portion is attached coaxially with the photosensitive drum 4. With the drum driving coupling 28, a coupling (not shown) on the apparatus main assembly side as a drum drive output portion is to be engaged, so that a driving force from a driving motor (not shown) of the apparatus main assembly is transmitted. As a result, the photosensitive drum 4 is rotationally driven in the counterclockwise direction at the predetermined speed as shown in FIGS. 1 and 4. The charging roller 5 is a charging member of a contact charging type in which the charging roller 5 is rotated by the photosensitive drum 4 in contact with the photosensitive drum 4. Further, the charging roller 5 is disposed and rotatably supported, at its shaft end portions on the driving side and the non-driving side, through bearings (not shown) provided between side plates of the cleaning device 26.

The cleaning blade 7 is an elastic rubber blade and performs a function of removing toner remaining on the photosensitive drum 4. The transfer residual toner removed from a peripheral surface of the photosensitive drum 4 by the cleaning blade 7 is accommodated in the cleaning device 26.

Figure 5:
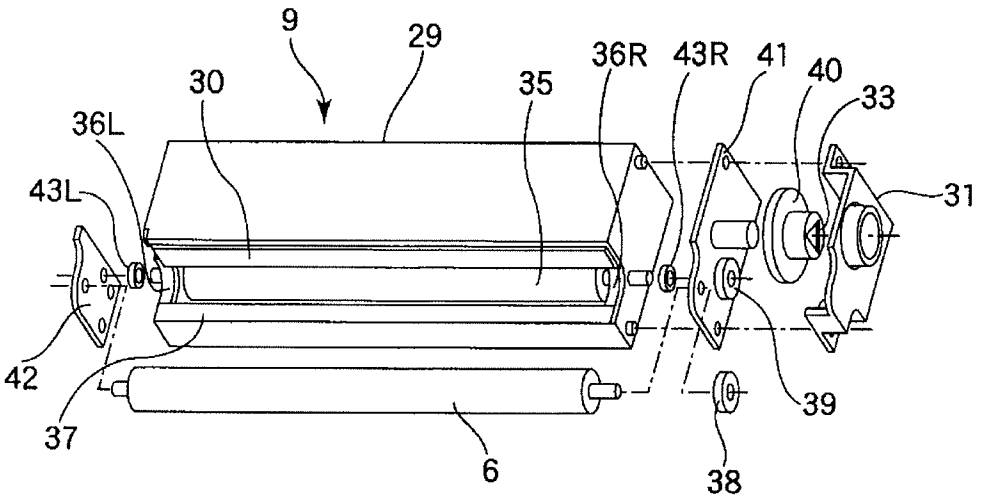
FIG. 5 is an exploded perspective view of the developing device of the present invention in the embodiment.

As shown in FIG. 5, the developing device 9 has an elongated shape extending in, as its longitudinal direction, a rotational axis direction of the developing roller 6 as the developing means. The developing device 9 includes a developing container 29 which constitutes a developer accommodating portion and functions as a second frame by which the developing roller 6 is rotatably supported.

The developing device 9 includes, in addition to the developing roller 6, a developing blade 30 and a developer supplying roller 35 in the developing container 29 and is constituted by mounting thereon end portion seal members 36R and 36L as a first seal member, a flexible sheet member 37 and supplying roller shaft seal members 43R and 43L as a second seal member.

Figure 2:
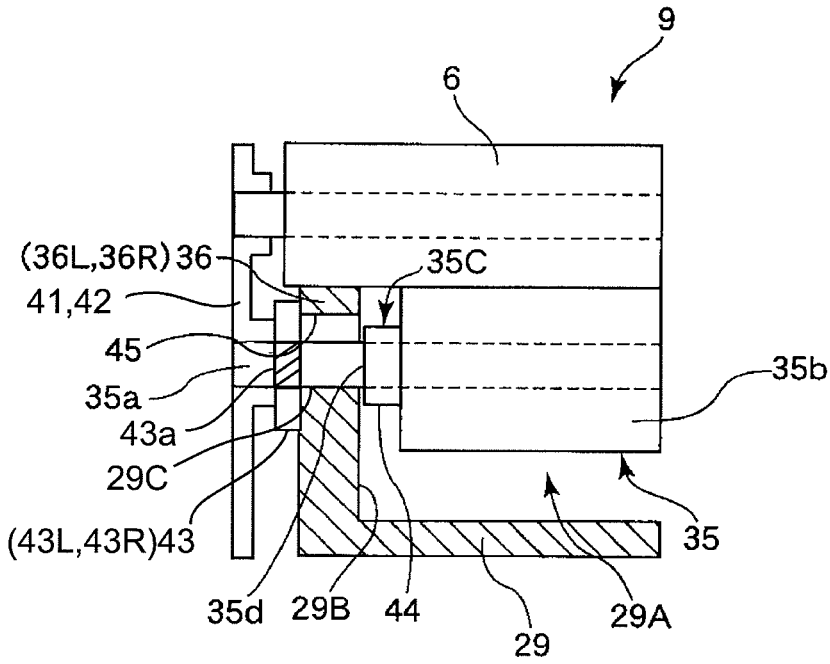
FIG. 2 is a sectional view showing a positional relationship between a developer supplying roller and an end portion seal member application bearing surface of a developing device in Embodiment 1 of the present invention.

The developer supplying roller 35 is constituted by a metal core material 35*a* and a cylindrical elastic member 35*b* of an urethane foam (FIG. 2). Further, the developer supplying roller 35 is disposed at an opening 29A (FIG. 4) (i.e., a developer supply opening for permitting supply of the developer to the developing roller 6) and is contacted to the developing roller 6.

Referring to FIG. 5, both end portions of the developing roller 6 and the core material 35*a* of the developer supplying roller 35 are rotatably supported by bearing members 41 and 42 attached to the developing container 29 on the driving side and the non-driving side.

At driving side end portions of the developing roller 6 and the developer supplying roller 35, a developing roller gear 38 and a developer supplying roller gear 39 are provided, respectively, and are engaged with a developing device drive input gear 40. The developing device drive input gear 40 includes a developing device driving coupling 33 with which a coupling (not shown) as a developing device drive output portion on the apparatus main assembly side is engaged, so that the driving force of the apparatus main assembly side driving motor (not shown) is transmitted to the developing device driving coupling 33. Then, the developing roller 6 and the developer supplying roller 35 are rotationally driven in the clockwise direction at the predetermined speed as shown in FIGS. 2 and 4.

During the development, the developer supplying roller 35 is rotated by the drive and rubs against the developing roller 6, so that the toner in the developing container 29 is carried on the developing roller 6. The developing blade 30 is provided counter directionally to the rotational direction of the developing roller 6 (the clockwise direction in FIGS. 1 and 6) at its end portion in contact with the developing roller 6. Therefore, the toner carried on the developing roller 6 is supplied with electric charge by the developing blade 30 through the rotation of the developing roller 6 and is subjected to regulation of its layer thickness of a predetermined small value. Then, at the contact portion between the developing roller 6 and the photosensitive drum 4, the toner on the developing roller 6 is deposited on the electrostatic latent image on the photosensitive drum 4, so that the electrostatic latent image is developed.

The toner which does not contribute to the development and remains on the developing roller 6 is returned into the developing container 29 by the rotation of the developing roller 6 and is separated s from the developing roller 6 at the rubbing portion with the developer supplying roller 35 to be collected. The collected toner is mixed with remaining toner in the developing container 29.

At both end portions of the opening (developer supply opening) 29A of the developing container 29, end portion seal members 36R and 36L are provided to prevent the toner leakage from the gap between the developing roller 6 and the developing container 29.

Further, with respect to the longitudinal direction of the opening 29A of the developing container 29, a flexible sheet member 37 is provided in contact with the developing roller 6, so that the toner leakage from the gap between the developing roller 6 and the developing container 29. Further, as shown in FIG. 5, outside the developing container 29, supplying roller shaft seals 43R and 43L are mounted around the core material 35*a* of the developer supplying roller 35, so that the toner leakage from the gap between the core material 35*a* and a through hole 29C, for the core material 35*a*, provided to the developing container 29 is prevented. To the core material 35*a* of the developer supplying roller 35, grease as a lubricant is applied at a contact portion (hatched portion) 43*a* (FIG. 2) with the supplying roller shaft seal, so that a toner leakage preventing effect is enhanced.

Further, as shown in FIG. 6, the developing device 9 is swingably supported about an axis b parallel to the drum axis a between the cover members 24 and 25 on the driving side and the non-driving side, respectively. On the driving side of the developing unit 9, a cylindrical portion 31A of the side cover 31 is rotatably supported by a cylindrical receiving hole 32 of the cover member 24 to constitute the swing center. On the non-driving side, a hole (not shown) at the developing container-side surface is rotatably supported by a shaft 34 of the cover member 25 to constitute the swing center. That is, the developing device 9 is rotatably connected with the drum unit 8 is always urged by an urging spring (not shown) so that the developing roller 6 is rotationally driven in the direction (counterclockwise direction in FIGS. 1 and 4) in which the developing roller 6 is contacted to the photosensitive drum 4.

<Detailed Constitution of Developing Device>

With reference to FIG. 2, a detailed constitution of the developing device 9 will be described.

The developer supplying roller 35 includes the metal core material 35*a* and the cylindrical elastic member 35*b* of urethane foam which is formed around the core material 35*a*. At a longitudinal end portion 35*c* of the cylindrical elastic member 35*b*, a small diameter portion 44 having an outer diameter smaller than that at a longitudinal central portion is formed. The outer diameter of the end portion 35*c* at the cylindrical elastic member 35*b*, i.e., the outer diameter of an end surface 35*d* of the small diameter portion 44 is located below the bearing surface 45 for application of the end portion seal member 36. That is, the end surface outer diameter of the small diameter portion 44 of the cylindrical elastic member 35*b* is made smaller than the central portion outer diameter so that the small diameter portion 44 does not overlap with the end portion seal member 36 with respect to a radial direction (i.e., so that the end surface 35*d* and the end portion seal member 36 are not contacted to each other).

According to this embodiment, even when the tolerance of the parts is relaxed, the end surface 35*d* of the small diameter portion 44 of the cylindrical elastic member 35*b* and the end portion seal member 36 are not contacted to each other and therefore it is possible to prevent the toner leakage from the gap of the end portion seal member 36 without increasing the cost.

As shown in FIG. 2, in this embodiment, when the supplying roller shaft seal 43 and the end portion seal member 36 are caused to overlap with each other so as to be contacted to each other, the toner leakage preventing effect can be enhanced. In a conventional developing device, in this case, the lubricant applied to the supplying roller shaft seal permeated the developer supplying roller via the end portion seal member, so that there was a possibility of an occurrence of the image defect by adherence of the lubricant to the developing roller surface. However, in this embodiment, the end surface 35*d* of the small diameter portion 44 of the cylindrical elastic member 35*b* and the end portion seal member 36 are not contacted to each other. For this reason, it is also possible to prevent the image defect due to the lubricant permeation.

(Embodiment 2)

Figure 7:
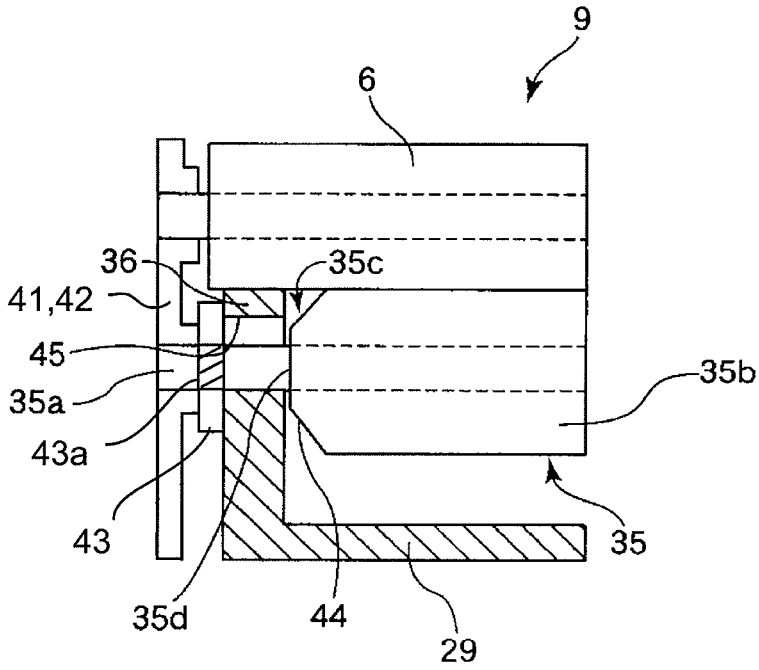
FIG. 7 is a sectional view showing a positional relationship between a developer supplying roller and an end portion seal member application bearing surface of the developing device of the present invention in Embodiment 2.

FIG. 7 shows the developing device of the present invention in this embodiment. In this embodiment, the general structure of the developing device is the same as that in Embodiment 1, thus being omitted from description. The developing device in this embodiment is different in end portion constitution from the developing device in Embodiment 1.

That is, in this embodiment, the outer diameter of the small diameter portion 44 at the end portion 35*c* of the cylindrical elastic member 35*b* is smaller toward the extreme end of the cylindrical elastic member 35*b*, i.e., the end portion 35*d*. The outer diameter portion of the end surface 35*d* of the cylindrical elastic member 35*b* is located below the bearing surface 45 for application of the end portion seal member 36 in the developing container 29. That is, the outer diameter of the end surface 35*d* is made smaller than the outer diameter of the central portion so that the end surface 35*d* and the end portion seal Member 36 are not contacted to each other.

According to this embodiment, the cylindrical elastic member 35*b* can be prepared by cutting the developer supplying roller 35, which has been formed in a certain outer diameter, while rotating the developer supplying roller 35. As a result, processing of the developer supplying roller 35 becomes easy, thus having no influence on mass-productivity of the developer supplying roller 35.

Figure 8:
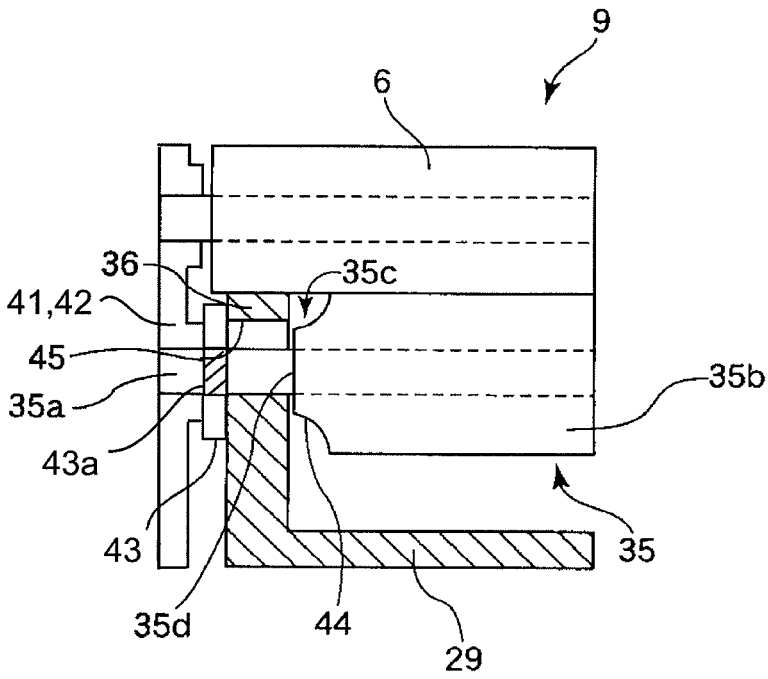
FIGS. 8, 9 and 10 are sectional views each showing the positional relationship between the developer supplying roller and the end portion seal member application bearing surface of the developing device of the present invention in a modified embodiment of Embodiment 2.
Figure 9:
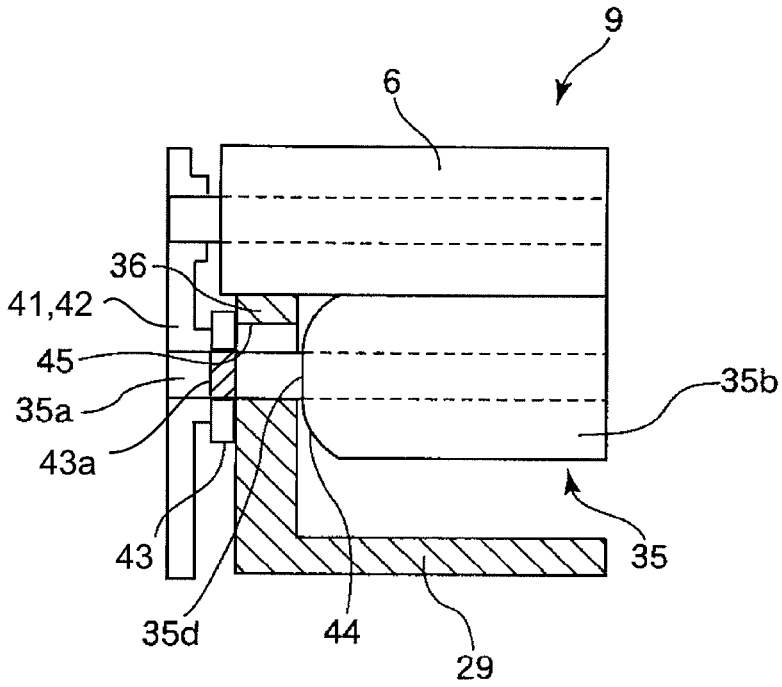
Figure 10:
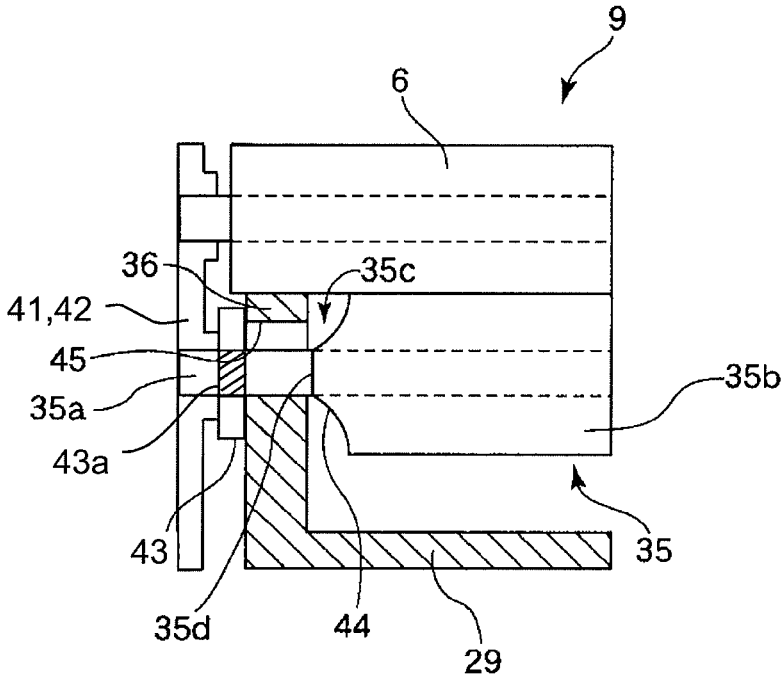

In the present invention, the shape of the end portion 35*c* may only be required that the outer diameter of the small diameter portion 44 is decreased with a distance toward the end surface 35*d*, in addition to the shape shown in FIG. 7. For example, shapes shown in FIGS. 8 to 10 may also be used as the shape of the end portion 35*a*. That is, it is possible to use the following shapes (1) to (3):

(1) a shape in which the outer surface of the small diameter portion 44 is decreased toward the end surface 35*d* of the cylindrical elastic member 35*b* while being bent in a concave shape (FIG. 8), (2) a shape in which the outer surface of the small diameter portion 44 is decreased toward the end surface 35*d* of the cylindrical elastic member 35*b* while being bent in a convex shape (FIG. 9), and (3) a shape in which the outer surface of the small diameter portion 44 is decreased toward the end surface 35*d* of the cylindrical elastic member 35*b* while being bent in a concave shape and in which the outer diameter of the end surface 35*d* of the cylindrical elastic member 35*b* is equal to the outer diameter of the core material 35*a*.

Also when these shapes (1) to (3) are used as the shape of the end portion 35*c*, the effects similar to those in Embodiment 1 (FIG. 2) and Embodiment 2 (FIG. 7) can be achieved.

(Embodiment 3)

Figure 11:
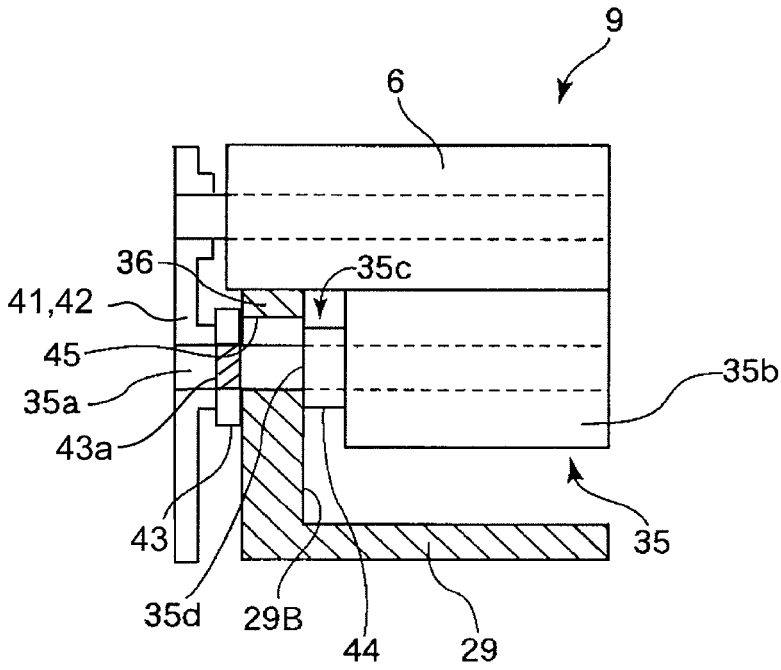
FIG. 11 is a sectional view showing a positional relationship between a developer supplying roller and an end portion seal member application bearing surface of the developing device of the present invention in Embodiment 3.

FIG. 11 shows the developing device of the present invention in this embodiment. In this embodiment, the general structure of the developing device is the same as that in Embodiment 1, thus being omitted from description. The developing device in this embodiment is different in end portion constitution from the developing device in Embodiment 1.

That is, in this embodiment, the end portion 35*c* (end surface 35*d*) of the cylindrical elastic member 35*b* is contacted to the opening 29A-side end portion (inner end surface 29B) of the developing container 29.

In the conventional developing device, when the end portion 35*c* of the cylindrical elastic member 35*b*, i.e., the end surface 35*d* was contacted to the opening 29A-side end portion (inner end portion 29B) of the developing container 29, the end surface 35*d* of the cylindrical elastic member 35*b* and the end portion seal member 36 were contacted to each other, so that there was a possibility of the occurrence of the toner leakage. For this reason, there was a need to provide a gap between the end surface 35*d* of the cylindrical elastic member 35*b* and the opening 29A-side end surface 35*d* of the developing container 35*d*.

According to the constitution in this embodiment, different from the conventional developing device, it is possible to contact the end portion of the cylindrical elastic member and the opening-side inner end surface of the developing container to each other with no influence on the toner leakage. For that reason, the longitudinal gap can be reduced, so that the developing device and the process cartridge can be further downsized with respect to the longitudinal direction compared with those in Embodiments 1 and 2.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 030299/2010 filed Feb. 15, 2010 and 022870/2011 filed Feb. 4, 2011, which are hereby incorporated by reference.

What is claimed is:

1. A developing device comprising:

a developing container, provided with an opening, for containing a developer;

a developing roller, provided at said opening, for forming a developer image on an image bearing member;

a seal member, provided at said opening along an end portion of said developing roller, for preventing toner leakage from a gap between said opening and said developing roller; and a developer supplying roller, including a core material and a cylindrical elastic member that is provided around said core material and is contacted to said developing roller, for supplying the developer to said developing roller, wherein said cylindrical elastic member has an end surface and a central portion with respect to a longitudinal direction thereof, and wherein said end surface has an outer diameter that is smaller than that of said central portion so as to not be in contact with said seal member, and wherein said end surface is contacted to an inner wall of said developing container.

2. A device according to claim 1, wherein said cylindrical elastic member has an end portion with respect to the longitudinal direction, and wherein said end portion has an outer diameter that is decreased toward said end surface.

3. A developing device comprising:

a developing container, provided with an opening, for containing a developer;

a developing roller, provided at said opening, for forming a developer image on an image bearing member;

a seal member, provided at said opening along an end portion of said developing roller, for preventing toner leakage from a gap between said opening and said developing roller;

a developer supplying roller, including a core material and a cylindrical elastic member that is provided around said core material and is contacted to said developing roller, for supplying the developer to said developing roller; and a second seal member, provided around said core material on an outside of said developing container, for preventing the toner leakage between said core material and a hole, provided to said developing container, through which said core material is penetrated, wherein said cylindrical elastic member has an end surface and a central portion with respect to a longitudinal direction thereof, wherein said end surface has an outer diameter smaller than that of said central portion, so as to not be in contact with said seal member, wherein a lubricant is applied to a contract portion between said core material and said second seal member, and wherein said seal member and said second seal member are contacted to each other.

4. A device according to claim 3, wherein said end surface is contacted to an inner wall of said developing container.

5. A device according to claim 3, wherein said cylindrical elastic member has an end portion with respect to the longitudinal direction, and wherein said end portion has an outer diameter that is deceased toward said end surface.

6. A process cartridge comprising:

an image bearing member for bearing an electrostatic latent image;

a developing container, provided with an opening, for containing a developer;

a developing roller, provided at said opening, for forming a developer image on said image bearing member;

a seal member, provided at said opening along an end portion of said developing roller, for preventing toner leakage from a gap between said opening and said developing roller; and a developer supplying roller, including a core material and a cylindrical elastic member that is provided around said core material and is contacted to said developing roller, for supplying the developer to said developing roller, wherein said cylindrical elastic member has an end surface and a central portion with respect to a longitudinal direction thereof, wherein said end surface has an outer diameter smaller than that of said central portion so as to not be in contact with said seal member, and wherein said end surface is contacted to an inner wall of said developing container.

7. A cartridge according to claim 6, wherein said cylindrical elastic member has an end portion with respect to the longitudinal direction, and wherein said end portion has an outer diameter that is decreased toward said end surface.

8. A process cartridge comprising:

an image bearing member for bearing an electrostatic latent image;

a developing container, provided with an opening, for containing a developer;

a developing roller, provided at said opening, for forming a developer image on said image bearing member;

a seal member, provided at said opening along an end portion of said developing roller, for preventing toner leakage from a gap between said opening and said developing roller;

a developer supplying roller, including a core material and a cylindrical elastic member that is provided around said core material and is contacted to said developing roller, for supplying the developer to said developing roller; and a second seal member, provided around said core material on an outside of said developing container, for preventing toner leakage between said core material and a hole, provided to said developing container, through which said core material is penetrated, wherein the cylindrical elastic member has an end surface and a central portion with respect to a longitudinal direction thereof, wherein said end surface has an outer diameter that is smaller than that of said central portion so as to not be in contact with said seal member, wherein a lubricant is applied to a contact portion between said core material and said second seal member, and wherein said seal member and said second seal member are contacted to each other.

9. A cartridge according to claim 8, wherein said cylindrical elastic member has an end portion with respect to the longitudinal direction, and wherein said end portion has an outer diameter that is decreased toward said end surface.

10. A cartridge according to claim 8, wherein said end surface is contacted to an inner wall of said developing container.

* * * * *